United States Patent [19]

Adam et al.

[11] 4,318,570

[45] Mar. 9, 1982

[54] STRUCTURE FOR SEATING MEANS

[75] Inventors: Adriana Adam; Ana Beatriz M. Gomes, both of Sao Paulo, Brazil

[73] Assignee: Forma S.A Moveis e Objetos de Arte, Sao Paulo, Brazil

[21] Appl. No.: 75,062

[22] Filed: Sep. 12, 1979

[30] Foreign Application Priority Data

Aug. 9, 1978 [BR] Brazil ..... 7805141

[51] Int. Cl.[3] ..... A47C 3/00; A47C 4/02

[52] U.S. Cl. ..... 297/445; 248/188.7; 297/232; 297/444; 297/455

[58] Field of Search ..... 297/445, 440, 442, 443, 297/444, 452, 455, 456, 232; 248/188.7

[56] References Cited

U.S. PATENT DOCUMENTS

| | | | |
|---|---|---|---|
| 3,617,623 | 11/1971 | Schneiderman | 248/188.7 |
| 3,814,474 | 6/1974 | Baker | 297/440 |
| 3,942,836 | 3/1976 | Baker | 297/452 |
| 4,005,841 | 2/1977 | Rensland | 248/188.7 |
| 4,152,023 | 5/1979 | Buhk | 297/445 X |
| 4,169,625 | 10/1979 | Petersen | 248/188.7 |
| 4,339,280 | 12/1980 | Ackerman | 297/443 |

FOREIGN PATENT DOCUMENTS

| | | | |
|---|---|---|---|
| 795603 | 10/1968 | Canada | 248/788.1 |
| 2227713 | 12/1973 | Fed. Rep. of Germany | 297/445 |

*Primary Examiner*—James T. McCall

*Attorney, Agent, or Firm*—Beveridge, DeGrandi & Kline

[57] ABSTRACT

The seat and back of a seating unit are each formed of a plurality of cushioned upholstered elements which extend between a pair of L-shaped support members to provide continuous back and seat surfaces. The L-shaped members have an elliptical cross section which includes two hollow semielliptical portions, a central wall connecting these portions, and two longitudinal channels on opposite sides of the central wall. The upholstered elements are attached to the L-shaped members by plastic guiding strips which ride in the channels.

3 Claims, 3 Drawing Figures

STRUCTURE FOR SEATING MEANS

It is the object of this invention an improved structure preferably made of metallic material to shape up and provide combined and associated, individual or multiple seating means for use in offices, theaters, conference rooms, and working or resting places in general.

In spite of the art having reached a stage of development and sophistication by which nothing more novel may be thought about improving the basic functions of the seat, back and arms elements of a chair aside of their aesthetic aspect, the applicant was notwithstanding able to create a new supporting and structural framework for chairs quite different from everything known in the art.

The invention is substantially directed to a structure for chairs and similar formed by hollow, extruded elements duly assembled by means of fastening devices, designed so as to allow adaptation of the seating device to any desired or conceivable purpose as separate unit or collective arrangements.

One objective of this invention is to allow large-scale manufacture of the chair through the high speed production stock-piling of structural elements and to easy and practical assembling thereof in accordance with the selected and specified type of chair.

Another objective of this invention is to provide a multi-purpose, multi function individual and collective seating system allowing a wide range of solutions for seating arrangements for offices, theaters, meeting rooms, waiting rooms, conference places and any other working or resting sites providing single units like swivel chairs, back tilting arm chairs, fixed chairs and so on, as well as composite collective arrangements for audithoriums, classrooms and other public sites.

Yet, another advantage flowing from the use of hollow structural elements as taught in this invention, is found in employing the resulting inner channels for housing electric wires and connections of any desired electrical equipment to be employed by the chair's user.

The invention will be better disclosed and illustrated by way of example with no restrictive aim, in the accompanying drawings stressing out that the shown designs assembling arrangements and aesthetic details may vary without exceeding the scope of this invention.

IN THE DRAWINGS

Figure 1:
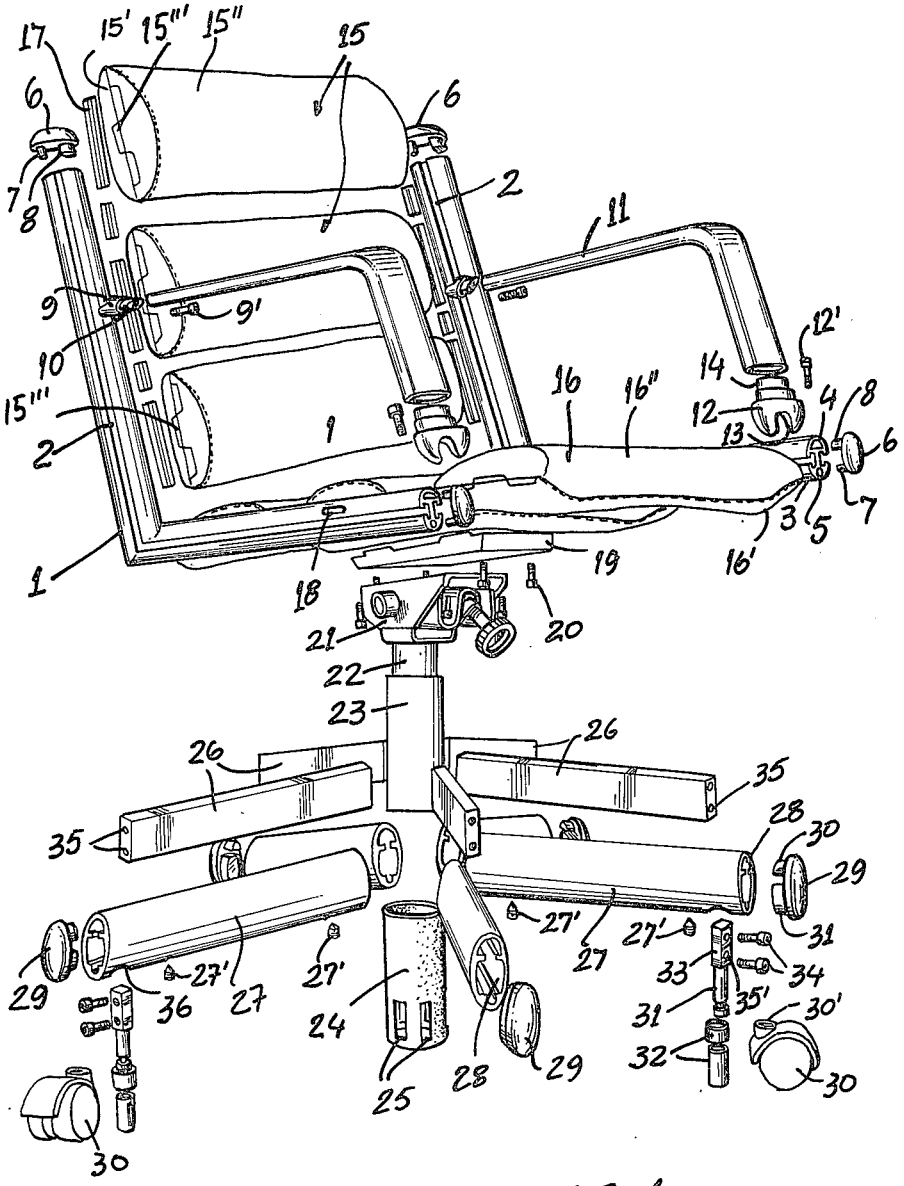
FIG. 1 shows in exploded, perspective view the basic frame fitted with the basic components of a swivel chair as per this invention.

In FIG. 1 the seating unit of the invention is shown with its elements in a broken away view in which the upper structure is formed by two L shaped, hollow, oval cross section members 1 with two opposite longitudinal recesses 2 determined by the inner profile of the said members 1 having two opposite elliptical sections 3,4, the lower one 3 having an axial bore 5 the inlets 4 receiving the complementary projections 7, 8 of the caps 6.

The arm elements of the chair, optionally applied are represented by hollow members 11 with oval cross-section and open ends which cooperate with the elliptical neck 10 of a connecting plug 9 fastened to the vertical branch of the "L" structure 1 by the screw 9' and with the sloped neck 14 of a connecting ogive-like device 12 fastened onto the horizontal branch of structure 1 by means of the screw 12' and mounted thereon thanks to the parabolic slot 13.

The working surfaces of the chair's back seat are basically formed by spaced upholstered elements 15, 16 which collectively define argonometrically designed supporting areas. The back cushions 15 form a curved and upholstered leaning zone 15''. Each cushion 15 is supported by a rigid like base 15' which is fixed between the vertical legs of structure sliding along the longitudinal channel 2 by their fin like protuberances 15'''. A stabilizing intermediary strip 17 of plastic material is provided to prevent direct contact of the metallic surfaces 1 and 15'.

The seat unit, is formed by several independent elements with upholstered surfaces 16'' supported by rigid tray like bases 16' whose lateral projections 16 may slide along the recess 2 guided by an intermediary plastic slotted strip 17, which are fastened to the framework 1 by bolts 18.

The linking between the upper seat and back structure 1 and the leg assembly is performed by the plate 19 fixed under the elements 16 (FIG. 1) by screws 20. In cases when the chair is to be equipped with swivel-and-tilt mechanism 21 this will be mounted on top of the telescopic rotary shaft 22 which is slidable along the cylindric hollow post 23 for the adjustment of the height of the seat.

The leg assembly is formed by the structural combination of prismatic massive metal bars 24, radially projecting from the said hollow post 23, and provided with front holes 35, each of them being fully encased by an extruded elliptical sleeve 27, whose free end 28 is shaped in such a way to form a profiled inlet to firmly receive the curved projections 30, 31 of the terminal caps 29.

The post 23 is encased into the cylindrical sleeve 24 provided with vertical windows 25 in its lower portion through which emerge the said core bars 26 (FIG. 1) of the feet of the chair.

In fasten the elliptical sleeves 27 threaded bolts 27' are located at both ends thereof.

In case the chair is to be equipped with wheeled feet the wheels 30 will be freely mounted on the rotary axle 31 whose lower end is purposedly provided with an axle-sleeve and ring 32 which are lodged into the hole 30 of the wheel. The axle 31 has its upper end prismatically enlarged 33 at with spaced bores 35' which match with the front holes 35 of the core bars 26 to allow the penetration of the screws 34.

Figure 2:
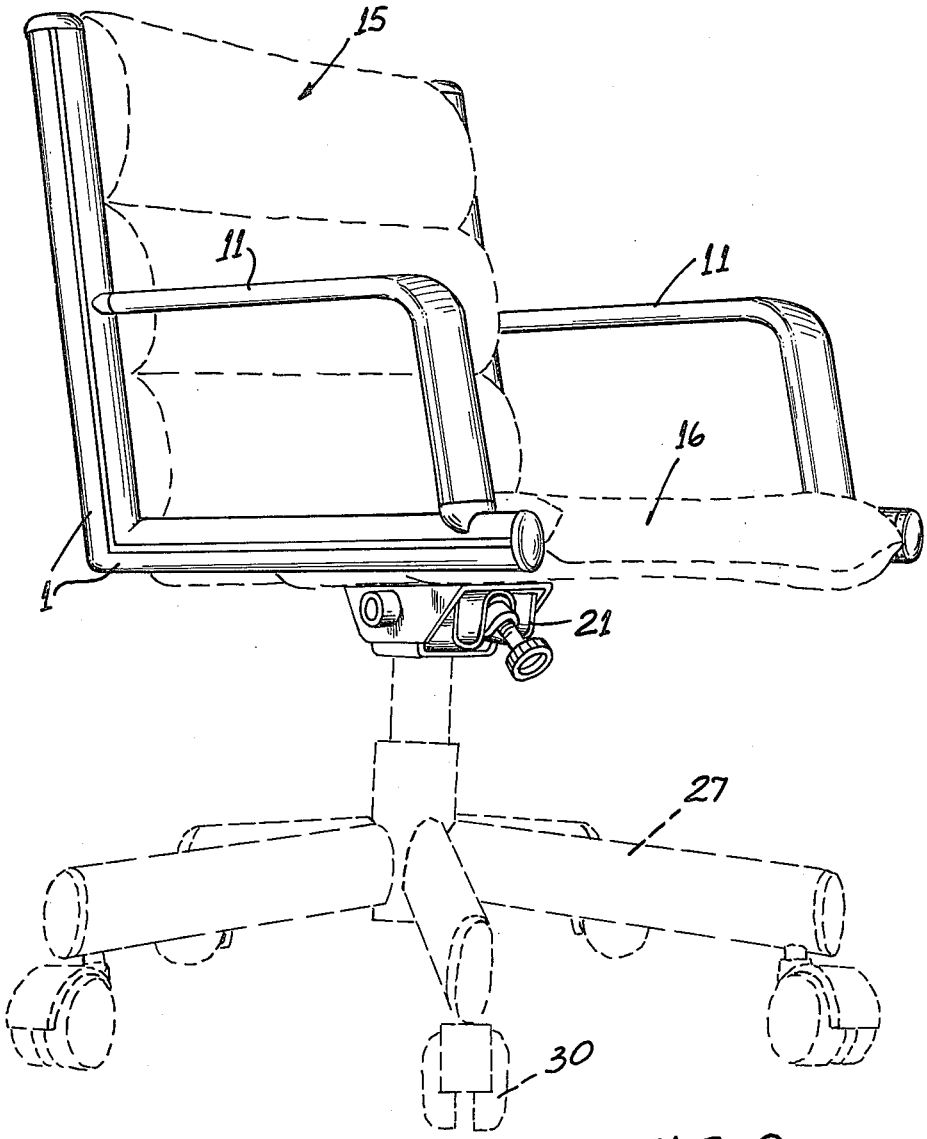
FIG. 2 shows in full lines the assembled unit of FIG. 1 and in dotted lines the usual wheeled legs unit and FIG. 3 is a perspective view of an example of seating assembly of three seat units of this invention for use in conference rooms.
Figure 3:
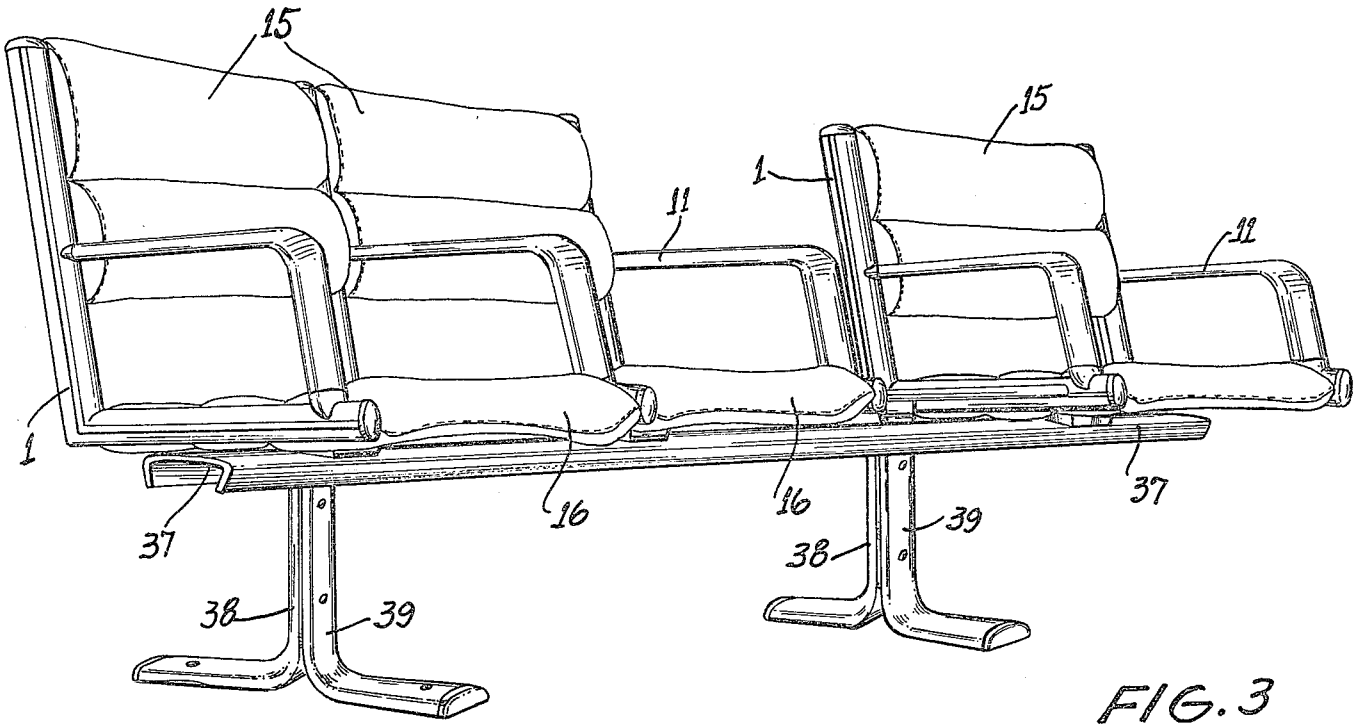

In FIG. 2, a seat unit of the type shown in FIG. 1 is used in a swivel and roller chair. It should be understood that the leg unit may vary in accordance with the specific use of the seating means. For example, FIG. 3 shows an auditorium row of chairs with a series of seat and back structures 1, 15, 16 aligned and collectively supported by a beam 37. The beam 37 is supported on its ends by two leg units, each being formed by two.

What we claim is:

1. An improved seating means, comprising, a seat and back unit having two upright parallel L-shaped members which have a generally elliptical cross section with a central wall, two hollow semielliptical portions at opposite ends of the central wall and two longitudinal channels on opposite sides of the central wall; said members having terminal caps provided with projections which are pressed into the opposite ends of the L-shaped members, a plurality of independent upholstered elements connected to the L-shaped members to form the seat of the seating means, another plurality of independent upholstered elements connected to the L-shaped members to form the back of the seating means, each of said upholstered elements having a cushioned working force and a tray like base, each of said upholstered elements having lateral fin like protuberances at its opposite ends, and plastic guiding strips engaged with the protuberances and fitted in said channels for removably attaching the upholstered elements to the L-shaped members.

2. The improved seating means of claim 1, including two arms formed of hollow inverted L-shaped members, connecting plugs and terminals for connecting the arms to the upright L-shaped members, each said connecting plugs being connected to an upright L-shaped member and having a sloped neck receiving one end of a said arm, and each said terminal receiving the other end of a said arm and having a curved slot fitted over the upright L-shaped member.

3. The improved seating means of claim 1 or claim 2 wherein the upholstered elements are disposed to provide the seating means with a continuous back surface and a continuous seat surface.

* * * * *